US007428920B2

(12) United States Patent
Antonijevic

(10) Patent No.: US 7,428,920 B2
(45) Date of Patent: Sep. 30, 2008

(54) FIN FOR HEAT EXCHANGER

(75) Inventor: Dragi Antonijevic, Köln (DE)

(73) Assignee: Visteon Global Technologies, Inc., Van Buren Township, MI (US)

( * ) Notice: Subject to any disclaimer, the term of this patent is extended or adjusted under 35 U.S.C. 154(b) by 438 days.

(21) Appl. No.: 10/922,469

(22) Filed: Aug. 20, 2004

(65) Prior Publication Data

US 2005/0077036 A1 Apr. 14, 2005

(30) Foreign Application Priority Data

Aug. 21, 2003 (DE) ..... 103 39 286
Dec. 16, 2003 (DE) ..... 103 60 240

(51) Int. Cl.
*F28D 1/02* (2006.01)
*F28F 1/00* (2006.01)
*F28F 1/42* (2006.01)

(52) U.S. Cl. ..... 165/152; 165/177; 165/179

(58) Field of Classification Search ..... 165/151, 165/152, 177, 179
See application file for complete search history.

(56) References Cited

U.S. PATENT DOCUMENTS 4,328,861 A 5/1982 Cheong et al.
4,958,681 A 9/1990 Kadle
5,035,052 A * 7/1991 Suzuki et al. ..... 165/151
5,099,914 A * 3/1992 Reifel ..... 165/151
5,117,902 A 6/1992 Kusuhara et al.
5,669,438 A 9/1997 Beales et al.
5,730,214 A 3/1998 Beamer et al.
5,738,169 A 4/1998 Stoynoff
5,765,630 A 6/1998 Bloomer
6,401,809 B1 * 6/2002 Zhang et al. ..... 165/152
7,021,370 B2 * 4/2006 Papapanu et al. ..... 165/151

* cited by examiner

*Primary Examiner*—Ljiljana (Lil) V Ciric
(74) *Attorney, Agent, or Firm*—Brinks Hofer Gilson & Lione

(57) ABSTRACT

A heat exchanger with at least one louver arrangement in the region between associated tubes for the heat transfer from one medium to another medium. The louver arrangement is provided with an inflow part and an outflow part corresponding to the inflow part. Both flow parts each have one outside louver, at least one intermediate louver and one inside louver, whereby the inside louvers are connected to each other and the louvers of one flow part are arranged inclined relative to the louvers of the other flow part and provided with louver geometry elements—length L, width B, angle of inclination α—, whereby between adjacent inclined louvers each there are passage slots for the flowing medium. The louver arrangement is provided at least in one of both flow parts with at least one at least single-curved intermediate louver and/or at least one multiple-curved outside louver and/or inside as geometry elements.

27 Claims, 9 Drawing Sheets

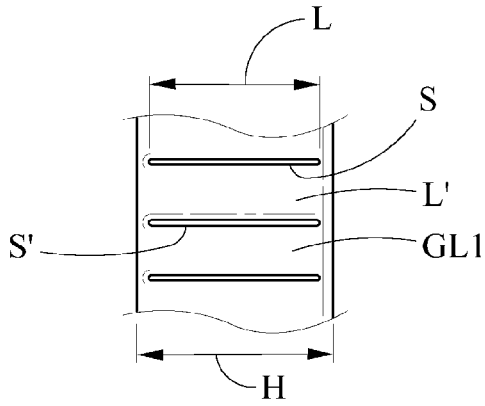
Fig. 12
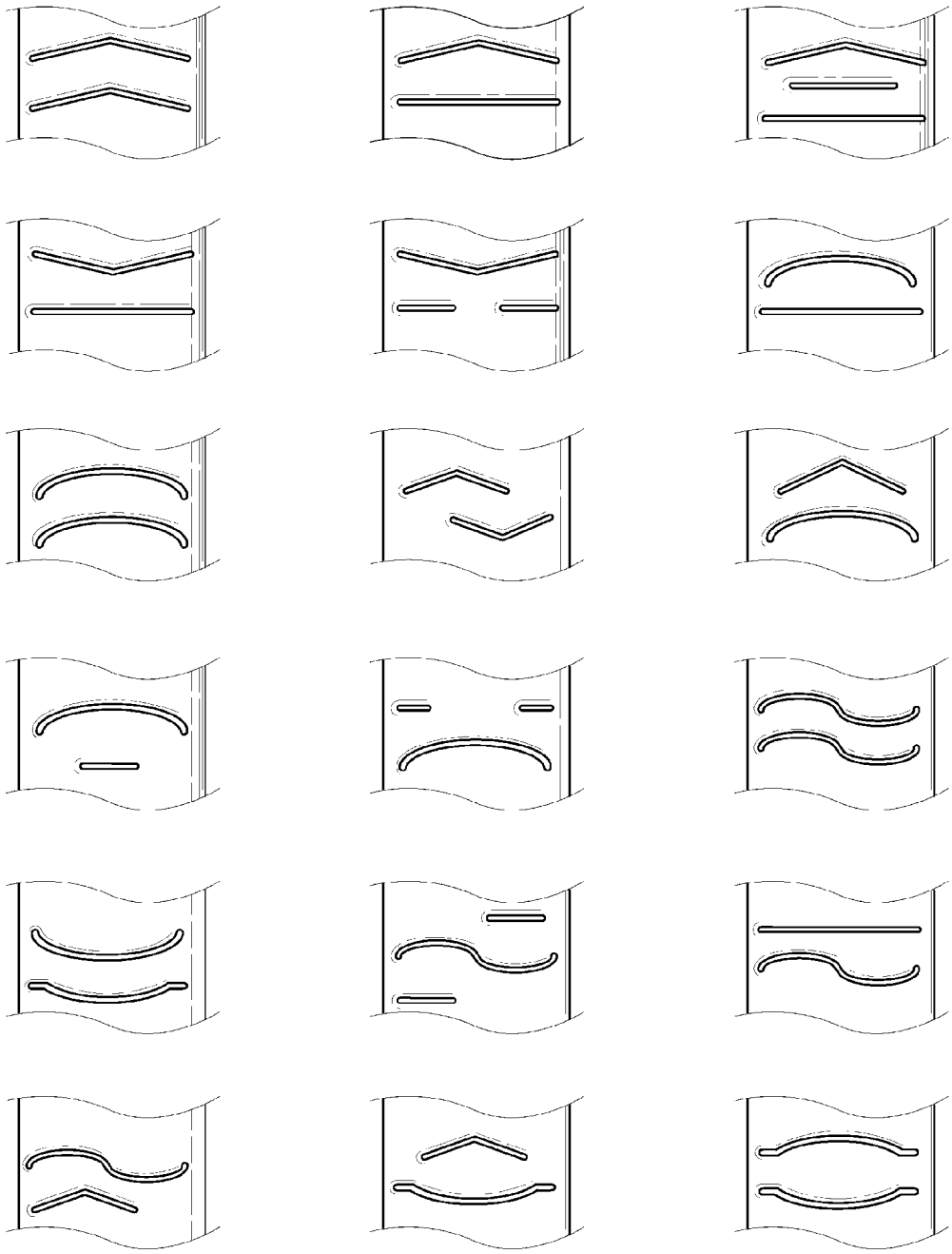

FIN FOR HEAT EXCHANGER

BACKGROUND

1. Field of the Invention

The invention relates to a fin for heat exchangers with at least one louver arrangement in the region between associated tubes for the heat transfer from one medium to another medium. More specifically, the louver arrangement is provided with an inflow part, an outflow part corresponding to the inflow part, with both flow parts having one outside louver, at least one intermediate louver and one inside louver.

2. Related Technology

The majority of the heat exchangers currently used in automotive applications possess a heat transfer core which contains heat transfer tubes, arranged one above the other in series, and fins between the tubes, whereby louvers are located in the fin surface. Heat transfer is from the heat transfer tubes to the fins with louvers, or vice versa. The louvers direct medium stream over the fin surface and through the fin surface, create a controlled degree of turbulence and are intended to enhance the heat transfer between the flowing medium and the fin.

In conventional fins particularly, the intermediate louvers are provided with louver geometry elements "of equal louver length L", "of equal louver angle of inclination $\alpha$, and "of equal louver width B" in the inflow part and the corresponding outflow part each.

The louver geometry element "all louvers of equal length L" essentially means that the passage slots of all louvers, and thus all louvers, are of equal length.

The outside louver, the intermediate louvers and the inside louver of each flow part, if there is the louver geometry element "all louvers of equal louver angle of inclination $\alpha$", have an equally directed angle of inclination. However, the directions of the angle of inclination in both flow parts are different, but mirror symmetrical to the fin midplane. Further the intermediate louvers have, if they have the louver geometry element "of equal louver width B", an equal width and differ from the widths of the bent parts of the outer louver and the inner louver, which in most cases are equal to the half of the width of the intermediate louvers.

Other lover fins for heat exchangers are described in U.S. Pat. No. 4,328,861, whereby the heat exchangers have a structure of heat exchanger tubes and a fin core or flat fin baffles. The heat transfer tubes are designed in from of flat tubes. The fins are equipped with Venetian blind-like louvers extending parallel to the row of tubes in longitudinal direction inclusive of associated passage slots and have a piece reaching beyond the row of tubes. The fins between the tubes have passage slots of constant length, outside of the tube region there is a row of slots progressively shortened in longitudinal direction. Each of the slots outside of the tube region is shorter the normal slots arranged in row between the adjacent flat tubes, whereby the row of slots shortened in longitudinal direction is formed near to the outer edge of the projecting piece of the fin beyond the edges of the flat tubes and the shortest slot is arranged adjacent to the edge of the row of flat tubes. Therefore, outside of the flat tube regions in the row of longitudinally shortened louvers, each louver is shorter than the length of the normal louvers located between the adjacent louvers in a row, whereby the row of longitudinally shortened louvers is arranged formed in the projecting region of the fin between the outer edge of the fin beyond the end of the row of tubes.

Another heat exchanger with enclosing louver fin channels is known from U.S. Pat. No. 4,958,681. In the heat exchanger there is a plurality of round tubes and a plurality of fins located between the tubes. The fins are surrounded with many louvers and are thermally connected to the tubes, in order to enhance the heat transfer capacity of the heat exchanger. The fins consist of louvers and flat regions. The louvers are located between the pairs of tubes and are arranged at a distance to them on an adjacent fin region and by means of circular arc-shaped flat regions of equal width, which serve as circular-arc circulation channels of equal width. The ratio between the width of the circular-arc circulation channels and the distance between the adjacent tubes is to have an optimal value, whereby the louvers are intended to create the effect that heat transfer and air pressure drop of the heat exchanger increase when the characteristic of the heat transfer increases against the air pressure drop.

A tube-shaped heat exchanger for air conditioning units is described in U.S. Pat. No. 5,117,902, which consists of a plurality of fin plates arranged at regular distances parallel to each other; a plurality of heat transfer tubes arranged in at least one row and vertical to the fin plates; a plurality of projecting strips on each fin plate, whereby the strips are vertical to the air stream and formed projecting from the fin plate surface, and at least one diverting surface on each fin plate, whereby the surface extends along the central line of the row of heat transfer tubes.

In such a tube heat exchanger, air can flow between the fin plates while a liquid can flow in the heat transfer tubes. Each projecting strip can incline in two directions, depending on the direction of flow. In addition, the number of projecting strips of the row near to the longitudinal edge of the fin plate is bigger than the number of strips in the row near to the central line of the heat transfer tubes. No strips are provided on the diverting surface.

In U.S. Pat. No. 5,669,438 a corrugated heat transfer fin with a series of flat fin walls is described. The fin walls are one-piece folded with alternating crest lines, with a given fin wall width measured between the crest lines. The crest lines are established such that they can be connected to parallel, flat heat transfer tubes to form fluid flow passages existing between neighboring or adjacent fin walls and the tubes. A fluid is pressed through the tubes in a direction generally parallel to the crest lines. Each of the adjacent flow passages has also a restricted section within the inner surface of a crest line and an opposite, non-restricted section between the outer surfaces of the two adjacent crest lines. Each fin wall is formed with a series of one-piece, essentially planar louvers are bent out of the wall, whereby each of the louvers has a length generally parallel to the fin wall width.

Each louver is inclined from and through the plane of its fin wall about a slanting axis. Hereby one diagonal half of the louver is essentially completely moved onto one side of the fin wall and, accordingly, the other diagonal half of the louver is essentially moved onto the other side of the fin wall. The diagonally opposite corners of the louvers are moved into the non-restricted sections and from the restricted sections of the adjacent flow passages relative to each of the fin walls.

U.S. Pat. No. 5,730,214 describes a cooling fin heat exchanger with adjustable louver arrangement in which the louvers have varying angles. The louver arrangement consists of three parts—an inflow part, a louver-free central part and an outflow part. The inlet part and the outflow part each have an outside bent louver and several intermediate louvers. All louvers are arranged in symmetry of the inflow part and the corresponding outflow part to the central part midplane. The central part is connected to both inside intermediate louvers opposite to each other and offset to the fin plate plane. The intermediate louvers with the louver geometry elements "of equal louver length L", "of unequal louver inclination angles α increasing beginning from the outside bent louvers directed to the central part", and "of equal louver width B of the intermediate louvers" with the louvers being formed over the entire louver width are provided. Symmetrical to the central part in the inlet and outflow parts, outside bent louvers with unequal louver inclination angles are also provided. While the louvers within each traditional set of patterns "inflow part/outflow part" are uniform in length, width, slope and direction of the angle of inclination, the amount of the angle of inclination in each case can increase from the outside louver to the inside louver. In this case, the angles of inclination increase in direction of the air flow in the inflow part directed to the central part and at the same time continuously decrease in the outflow part. The louver inclination angles α are given, particularly, increasing beginning from 22° related to the outside bent louvers over 30° up to 40° relative to the last inside intermediate louvers for the inflow part, and accordingly decreasing for the outflow part. Thus, the louver inclination angle essentially stepwisely increases in direction to the central part and again stepwisely decreases in the outflow part up to its last outside bent louver to the angle of the outside bent louver of the inflow part. This means that essentially there is louver symmetry of the inlet and outflow parts relative to the central part. While the bent parts of the outside bent louvers have a width of only approximately half the louver width, the louvers connected to the central part have the same louver width as the other intermediate louvers. The central part is offset parallel to the fin plate plane at a distance in relation to the other flow parts.

A problem consists also in that, due to the big angles in the region of the central part, there are small turbulences which make the air flow onto the louvers in the region of the outflow part.

Another heat exchanger with louvers, which generate air turbulences, in the fins and the device to manufacture the louvers as well as a process to manufacture the fins are presented in U.S. Pat. No. 5,738,169. The heat exchanger consists of at least one row of flattened tubes through which a heat carrier flows. A fin rich of turns is, between two adjacent tubes, connected to the tubes. Within the fin there are a plurality of louvers, with each louver forming a longitudinal slot opening. A fluid to be heated or cooled by the medium passes the slot openings. An edge corrugated over one or several louvers causes turbulences in the fluid. The turbulences disturb the laminar flow of the fluid along the associated louvers.

From U.S. Pat. No. 5,765,630 a radiator with air flow directing fins is known, the fins being arranged at a defined angle relative to the sectional area of the radiator core. Air flowing into the radiator is accordingly diverted by the fins such that they go together with the angle of incidence of the fan blades blowing air into the radiator.

All known fins with their louver arrangements pose the problem, among others, of not having the optimal structure that makes possible a maximum heat transfer from one to another medium and a low pressure drop of the flowing medium after having passed the fins.

Therefore it is the object of the invention to provide a fin for heat exchangers which is adapted to be suitable so that the medium flow existing at the fin is optimally passed through the louver slots, the medium flows onto the louvers largely contacting them, turbulences are created, and a maximum heat transfer, as well as a low pressure drop within the flowing medium, are achieved.

SUMMARY

The above and other problems are solved by a fin for heat exchangers provided with at least one louver arrangement in the region between associated tubes for heat transfer from one medium to another medium. The louver arrangement is provided with an inflow part and an outflow part corresponding to the inflow part. Both flow parts each have one outside louver, at least one intermediate louver and one inside louver. The inside louvers are connected to each other and the louvers of one flow part are inclined relative to the louvers of the other flow part and provided with louver geometry elements—length L, width B, angle of inclination α—, whereby between each adjacent inclined louvers there are passage slots for the flowing medium.

According to the invention the louver arrangement, at least in one of both flow parts, is provided with at least one at least single-curved intermediate louver. Additionally, the louver arrangement may include at least one multiple-curved louver as geometry element. A curvature within a louver can be designed bend-like and/or arch-like.

The intermediate louvers can be arranged single-curved in direction of their width B, whereby at least one curved louver has at least one louver-internal inclination angle change $\alpha_{nO}/\alpha_{nU}$ preferably in an intersection point axis P between the louver longitudinal axis and the fin surface plane. The inclination angle change $\alpha_{nO}/\alpha_{nU}$ produces two unequally oriented louver parts within the louver, whereby $\alpha_{nO}$ are the fin-top angles of inclination associated to the louver part above the fin surface plane and $\alpha_{nU}$ are the fin-bottom angles of inclination associated to the louver part below the fin surface plane. Preferably each of the single-curved intermediate louvers has a fin-top louver part and a fin-bottom louver part, which each have two louver part inclination angles $\alpha_{nO}/\alpha_{nU}$ oriented unequal to each other with n=2 . . . 11 (louver numbers) within the intermediate louver.

The fin-top louver part inclination angles $\alpha_{nO}$ (above the fin surface plane in each flow part) can be equal by predefinition and at least one of the fin-bottom louver part inclination angles $\alpha_{nU}$ in the flow parts is dimensioned different to the others in each case.

On the other hand, the fin-bottom louver angles of inclination $\alpha_{nU}$ (below the fin surface plane in each flow part) can be equal by predefinition and at least one of the fin-top louver part inclination angles $\alpha_{nO}$ in the flow parts is dimensioned different to the others in each case.

The louvers can be designed multiple-curved in direction of the width B. In a multiple-curved louver there optionally is a louver-internal inclination angle change in an intersection point axis between the louver longitudinal axis P and the fin surface plane and/or at least one louver-internal inclination angle change in at least one axis that is directed outside of the intersection point axis P' between the louver longitudinal axis and the fin surface plane parallel to the intersection point axis P. The inclination angle changes, i.e. the multiple curvatures, with at least two and/or more unequal louver part inclination angles within one louver above and/or below the fin surface plane result in several louver parts along the width extension within one louver.

The curved louvers can be designed in the louver arrangement as louvers bent and/or arched along their length L as geometry element.

The louver arrangement can be provided with at least one louver that has, compared to at least one length L of the adjacent louver, an unequal louver length L' as geometry element, in at least one of both flow parts.

Each length L/L' of the louvers is largely dependent on the length of the passage slots S/S'.

The louver arrangement can contain at least one intermediate louver that has, compared to the width B/B'of at least one adjacent intermediate louver, an unequal louver width B' as geometry element, in at least one of both flow parts.

At least in the region of the intermediate louvers a longer medium passage slot S', compared to one of the adjacent shorter medium passage slots S, as geometry element can be assigned to two adjacent louvers.

Further, at least three adjacent louvers of the louver arrangement can be provided with, at least in one of both flow parts, unequal orientation-changing louver inclination angles $\alpha_{m+1}/\alpha_{m+2}/\alpha_{m+3}$ with m=0 . . . 9 for preferably twelve louvers such that at least one peak-like and/or groove-like course of the louver inclination angles $\alpha_{m+1}/\alpha_{m+2}/\alpha_{m+3}$ between the three adjacent louvers develops as geometry element. The peak-like and/or groove-like courses of the louvers can be capable to be transferred as geometry element to the louver arrangements with the curved louvers.

Generally, in most applications there is symmetry of the louver arrangement related to the louver midplane between the inflow part and the corresponding outflow part as geometry element. Also, an asymmetry related to the louver midplane between the inflow part and the corresponding outflow part as geometry element can be provided, whereby optionally the number and the shape of the louvers in the flow parts can be different.

The fin can largely be designed plate-shaped and preferably has a planar fin surface.

The louvers, the louver parts and their associated angles of inclination $\alpha$ can optionally be arranged, dependent on the demand and design of the heat exchanger, while maintaining the correspondence between the flow parts, also arranged exchanged symmetrically to the fin surface plane.

Optionally, the distance A between the adjacent louvers of the flow parts can be different. Further, the fins of this invention can optionally have a given distance to other parallely arranged fins in form of a given fin pitch $s_{fin}$ as geometry element within the heat exchanger.

In the fin, there may be particularly a combination of the louver geometry elements "inhomogeneous length L/L'of at least one louver relative to the adjacent louvers" and "establishment of the inhomogeneous upper/lower louver part inclination angles $\alpha_{nO}/\alpha_{nU}$ relative to the curved louvers".

The fin can have different shapes of the louver sectional profiles, particularly the establishment of the slot sections S, S' as geometry element. The guide lines of the passage slots can establish different louvers in such a way that different widths B/B', alternating lengths L/L' and/or changed curvatures and/or differently oriented louver part inclination angles $\alpha_r/\alpha_s/\alpha_t$ optionally varying from louver to louver, at least in one of both flow parts, can be provided.

The sectional profiles can have preferably concave, convex, arrow-like, coil-shaped, interrupted and other geometrically given contours and in compactness have different inclination angles $\alpha/\alpha'$, different louver widths B/B', different louver lengths L/L' and distances A/A', several inclination change axes P/P' in the region of the louvers as well as symmetries and asymmetries between the inflow parts and the corresponding outflow parts, whereby the apostrophized measurement parameters $\alpha'$, B', L', A', P' represent the changes.

The geometry elements can be combined singly, two-fold or multiply with one another, whereby the geometry elements can also be introduced at louvers all with equal louver width B and/or all with equal louver inclination angle $\alpha$ and/or all with equal louver length L.

The process for the production of a fin of the invention with at least one louver arrangement and at least one geometry element of the invention has the following steps:

1. definition of a fin after optional use of CAD programmes,
2. predetermination of static parameters of the fin dimensions and of geometry elements,
3. predetermination of dynamic parameters—e.g., medium inflow temperature, medium inflow velocity, medium outflow temperature, pressure drop,
4. execution of CFD simulations,
5. recording of heat transfer fields and
6. recording of medium flow fields preferably using laser devices,
7. evaluation of the heat transfer and flow fields obtained after measurement, particularly, of the medium outflow temperatures and the pressure drop,
8. variation and selection of the predetermined geometry elements for the fin with an optimization concerning the maximum heat transfer and minimum pressure drop,
9. evaluation of the CFD simulations and
10. manufacture of the optimized fin.

As the medium flowing to, through and from the louvers, preferably gases, particularly air, are used.

Using the fin of the invention improves the geometry of the medium side, particularly the air side of the heat exchangers, in the region between the heat transfer tubes and enhances the total performance of a fin. The total performance is defined such that within it a maximum heat transfer from one medium to another medium, with a reduced pressure drop of the flowing medium on the outflow side, can occur.

The fins of the invention can be produced without the need of large-scale investment in manufacture systems except for new tools. The assembly costs also remain largely within the traditional range.

BRIEF DESCRIPTION OF THE DRAWINGS

The invention will be described in detail by means of exemplary embodiments using drawings of which show:

FIG. 12 is a schematic representation of details in top view of fins according to the invention with different louver sectional and louver profiles.

DETAILED DESCRIPTION

Figure 1:
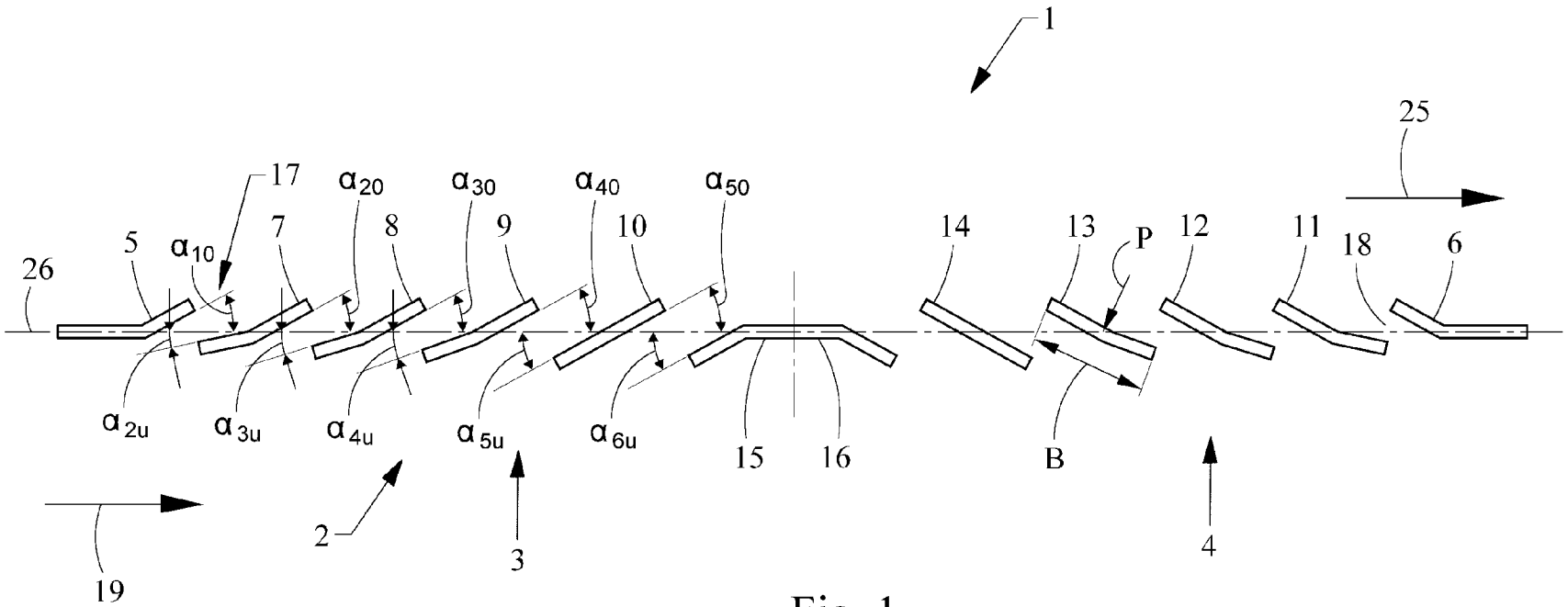
FIG. 1 is a schematic representation of a longitudinal section of a fin according to the invention with a louver arrangement in which louvers are curved and provided with two differently oriented louver part inclination angles within one louver.

FIG. 1 shows the schematic representation of a fin 1 according to the invention with at least one louver arrangement 2 for heat exchangers in the region between associated tubes for heat transfer from one medium to another medium. The louver arrangement 2 consists of two parts—an inflow part 3 and an outflow part 4 corresponding to it. The inflow part 3 and the outflow part 4 each respectively have an outside or outside bent louver 5, 6, at least one intermediate louver 7, 8, 9, 10 and 11, 12, 13, 14 and an inside or inside bent louver 15, 16. The inside bent louvers 15, 16 are connected to each other, the louvers 5, 7, 8, 9, 10, 15 of a flow part 3 are arranged inclined to the louvers 6, 11, 12, 13, 14, 16 of the other flow part 4 and provided with louver geometry elements—length, L, width B, inclination angle α—, whereby there are passage slots 17, 18 for the flowing medium between each adjacent louvers 5, 7, 8, 9, 10, and 6, 11, 12, 13, 14, 16.

According to the invention the louver arrangement 2 of FIG. 1, (and the lower arrangement 30 of FIG. 4) is provided at least in one of both flow parts 3, 4 with at least one single-curved or bent intermediate louver 7, 8, 9 and 11, 12, 13, 31, 32, 33. Alternately or additionally, the louver arrangement 2 may include at least one multiple-curved or bent louver as geometry elements.

The fin 1 is designed largely plate-shaped and has a preferably planar fin surface 26.

Figure 2:
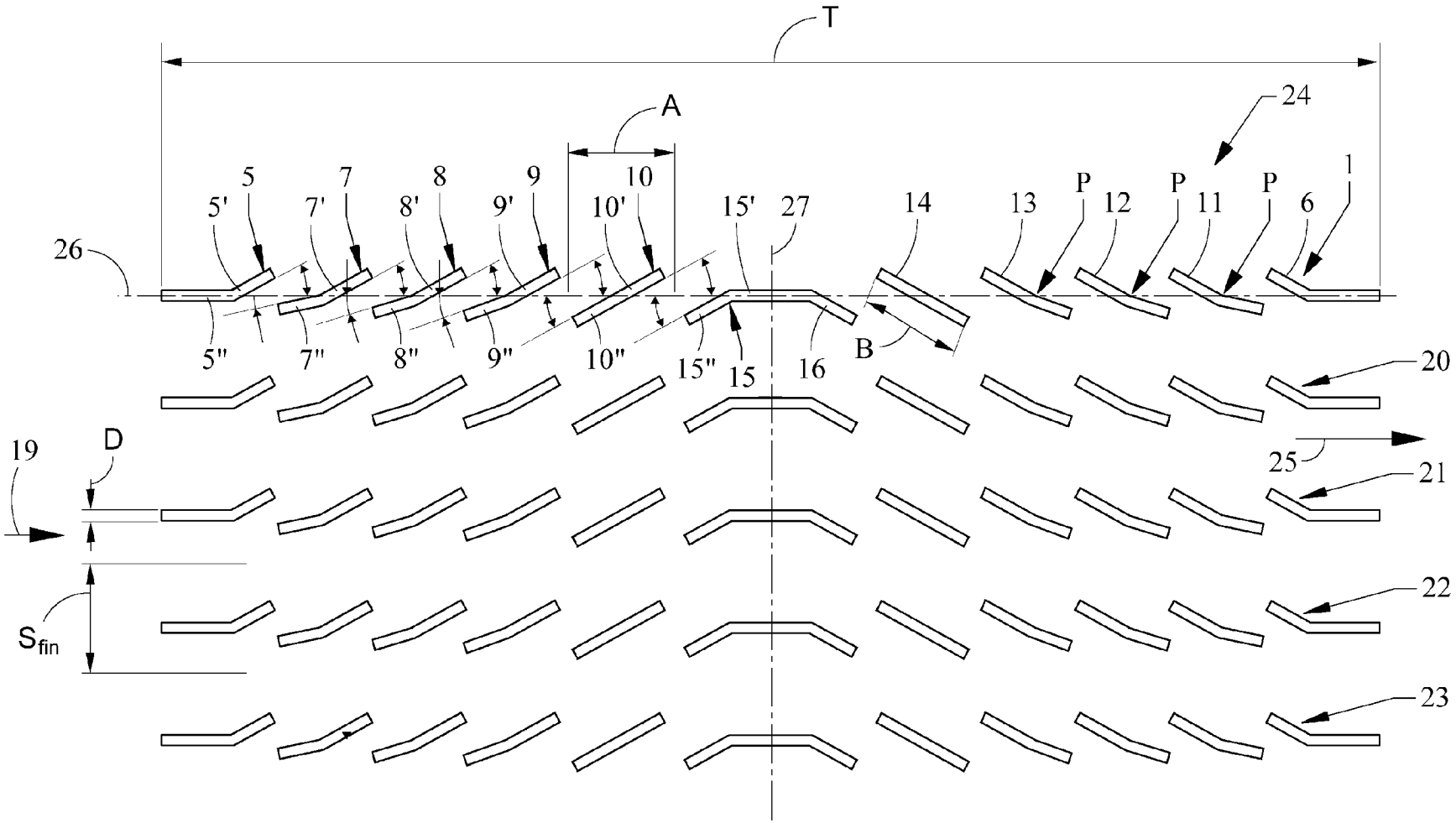
FIG. 2 is a schematic representation of several fins of the invention arranged parallel (with air flow direction arrows being shown) within a heat exchanger.

As seen in FIG. 1, each of the intermediate louvers 7 to 9 and 11 to 13 has one louver-internal inclination angle change, transverse to an inclination change axis P as intersection line between the louver longitudinal axis in the fin surface plane 26. Relative to the inclination change axis P, the curved or bent louvers 7, 8, 9 and 11, 12, 13 form a fin-top louver part 7', 8', 9' and 11', 12', 13' and a fin-bottom louver part 7", 8", 9" and 11", 12", 13" as shown in FIG. 2. The inclination angle changes consist in that, in each case, there are two unequally oriented louver part inclination angles $\alpha_{nO}/\alpha_{nU}$ with n=2 . . . 11 (louver numbers) within the louvers 7, 8, 9 and 11, 12, 13, whereby $\alpha_{nO}$ are the fin-top angles of inclination associated to the louver part above the fin surface plane 26 and $\alpha_{nU}$ are the fin-bottom angles of inclination associated to the louver part below the fin surface plane 26. The intermediate louvers 10, 14 are not bent, but designed flat over the entire width B.

The invention is not limited to the strict realization of the louver parts and inclination angles above and below the fin surface plane as shown in the FIGS. 1, 2. The louvers, the louver parts and the associated inclination angles α can, depending on the demand and design of the heat exchanger, also be arranged in relation to the fin surface plane 26 for all louvers.

In FIG. 1, in one example of embodiment, the fin-top louver part inclination angles αno above the fin surface plane 26 in the flow parts 3, 4 are equal by predefinition. The fin-bottom louver angles of inclination $\alpha_{nU}$ below the fin surface plane 26 are different in the flow parts 3, 4 in each case, with the exception of the inside louvers 15, 16. Table 1 shows a comparison between a traditional fin with the geometry G1, a first fin according to the invention with the geometry G2 and a second fin according to the invention with the geometry G3.

TABLE 1

| Louver part inclination angle for a flow part | G1/° Traditional base fin | G2/° First fin of the invention | G3/° Second fin of the invention |
|---|---|---|---|
| $\alpha_{1O}/\alpha_{1U}$ | 32/0 | 28/0 | 24/0 |
| $\alpha_{2O}/\alpha_{2U}$ | 32/32 | 28/12 | 24/12 |
| $\alpha_{3O}/\alpha_{3U}$ | 32/32 | 28/16 | 24/16 |
| $\alpha_{4O}/\alpha_{4U}$ | 32/32 | 28/22 | 24/20 |
| $\alpha_{5O}/\alpha_{5U}$ | 32/32 | 28/28 | 24/24 |
| $\alpha_{6O}/\alpha_{6U}$ | 0/32 | 0/28 | 0/24 |

In FIG. 2, the fin 1 with the geometry G2 is illustrated with fins 20, 21, 22, 23 and designated with the fin-top louver parts 5', 7', 8', 9', 10', 15' and the fin-bottom louver parts 5", 7", 8", 9", 10", 15". Viewing both FIGS. 1 and 2, the louver part inclination angles $\alpha_{nO}$ above the fin surface plane 26 of the five fin-top louver parts 5', 7', 8', 9', 10', 15' have an equal angle value $\alpha=\alpha_0$=28°, whereas the fin-bottom louver angles of inclination $\alpha_{nU}$ of the five fin-bottom louver parts 5", 7", 8", 9", 10", 15", according to Table 1, have a value at least partly increasing from the outside louver part 5" to the inside louver part 15", from 0° to 28°. The fin-bottom louver parts (not numbered) of the inflow part 3 fold open in their inclination against the direction of flow beginning from the outside louver 5 up to the inside louver 15. In the region of the outflow part 4 the fin-bottom louver parts 5", 7", 8", 9", 10", 15" fold down in their inclination beginning from the inside louver 16 in direction of the outside louver 6 and again reach the 0° level of the fin surface plane 26. Hereby there is a symmetry between the inflow part 3 and the outflow part 4.

Also another louver geometry element of the invention, "at least one of the louvers is multiple-curved in direction of the width B", can be realized in the fin, whereby at least one louver at least for one other time also outside of the inclination change axis P is provided with at least one louver-internal inclination angle change in the fin surface plane 26, whereby the inclination angle changes, i.e. multiple curvatures, with at least two and/or further unequal louver part inclination angles within one louver above and/or below the fin surface plane 26 lead to several louver parts along the width extension within a louver.

The parallel fins 1, 20, 21, 22, 23, shown schematically in FIG. 2, can be part of a heat exchanger 24 as traditionally provided in automotive heat exchangers—in radiators, heating cores, evaporators, condensers, charge-air coolers etc. The air as preferred medium inflowing from direction 19 (arrow) is partly passed between the fins 1, 20, 21, 22, 23 through the corresponding passage slots 17, 18 and the louvers 5 to 16 of the other fins 20 to 23. Particularly at the louvers 5 to 16 the inflowing air 19 can give off or absorb heat dependent on the temperature of the heat exchanger 24. The air outflowing from the fins 1, 20, 21, 22, 23 leaves the heat exchanger 24 in direction 25 (arrow) at an air outflow temperature $t_{air,\ aus}$ to be measured.

Figure 3:
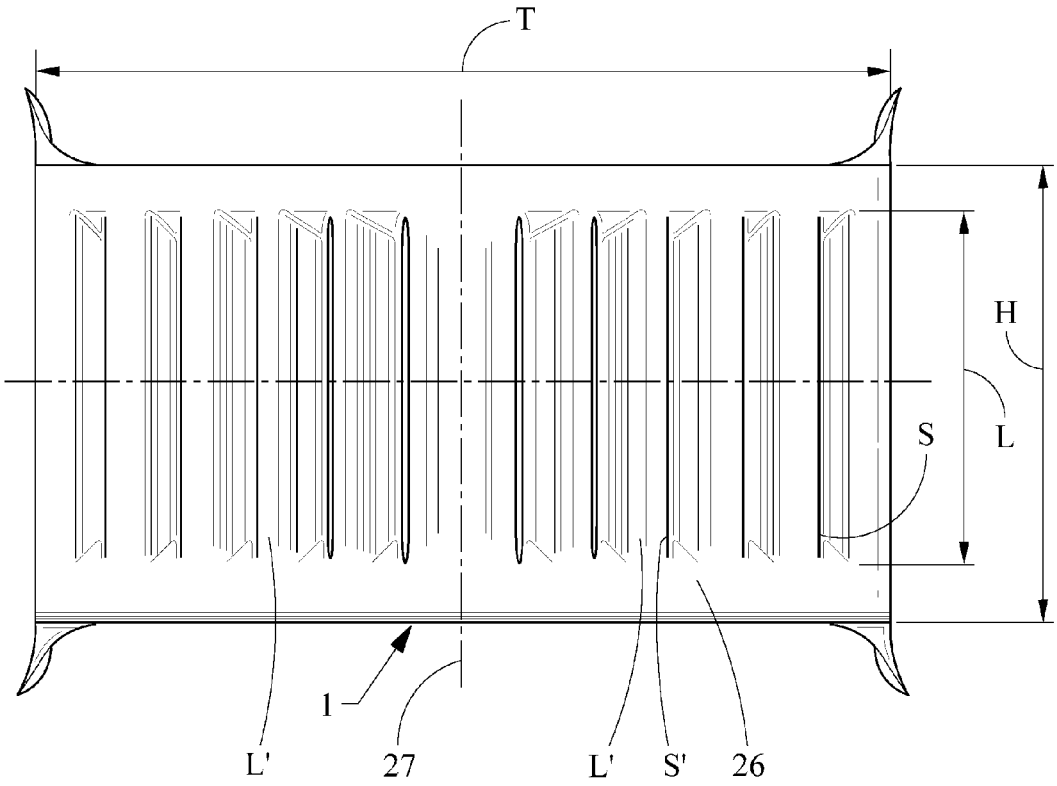
FIG. 3 is a top view of a fin of the invention with at least one louver with a longer passage slot or a longer louver, respectively, compared with the adjacent louvers.

In FIG. 3 the fin 1 is shown in top view. Referring to FIGS. 1, 2 and 3, the fin 1 can have the following dimensions as static parameters: fin depth T; fin height H; louver length L; louver width B; distance A between the louvers; fin-top louver part inclination angle $\alpha_O$; fin-bottom louver part inclination angle $\alpha_U$; material thickness D. The fin pitch, i.e. the distance between the fins which are arranged parallel to each other 1-0, 20-21, 21-22, 22-23, is given as $s_{fin}$. The louver widths B of the outside and inside louvers are largely half of the width B of the intermediate louvers 7, 8, 9, 10 and 11, 12, 13, 14. In the fin 1 there is also a louver with an elongated fin L' different from the length L. An elongated fin L' implies a longer slot S' compared to the other passage slots S.

Thereby, in general, a louver width B is, as it is shown in FIG. 2, the dimension angled to the fin surface plane 26 of a selected louver 14 in the longitudinal section of the fin 1. Generally, the louver inclination angle $\alpha$ is the angular setting of a respective louver or louver part relative to the fin surface plane 26. The fin height H and the fin depth Tare external dimensions of the fin 1. Between the louvers 5 to 16 there are passage slots S with the reference numbers 17, 18. Thus, for each flow part 3, 4 there are preferably six louvers 5, 7, 8, 9, 10, 15 and 6, 11, 12, 13, 14, 16 with five passage slots 17 and 18, respectively, in each case.

The outside bent louvers 5, 6 are the first and last louvers, respectively, in the louver arrangement 2. The inside bent louvers 15, 16 are connected to each other in the region of the fin midplane 27, are part of the fin surface and free of a slot in the common connection. Further, preferably the inflow part 3 and the corresponding outflow part 4 are mirror-symmetrical relative to the fin midplane 27.

In one embodiment of the invention, the curved louvers in the louver arrangement 2 can be arched along their width B and/or their length L so that the louver arrangement is provided with another louver geometry element "at least one of the louvers is single- and/or multiple-arched in direction of the width B and/or direction of the length L".

To optimally determine and finally realize fins that can be used in heat exchangers a known CFD simulation can be employed.

As distinct from a conventional base fin with the geometry G1, the known fin with the geometry Gus (from U.S. Pat. No. 5,730,214) and a fin with a geometry G4 having louvers with continuously increasing inclination angle, for different fin pitches, air inflow temperatures and velocities as well as different fin surface temperatures louver inclination angle combinations of fins with the geometries G5, G6, G7 have resulted from the CFD analysis, which for visible comparison are shown in Table 2 and FIGS. 5, 6 and FIGS. 7, 8, respectively.

Figure 4:
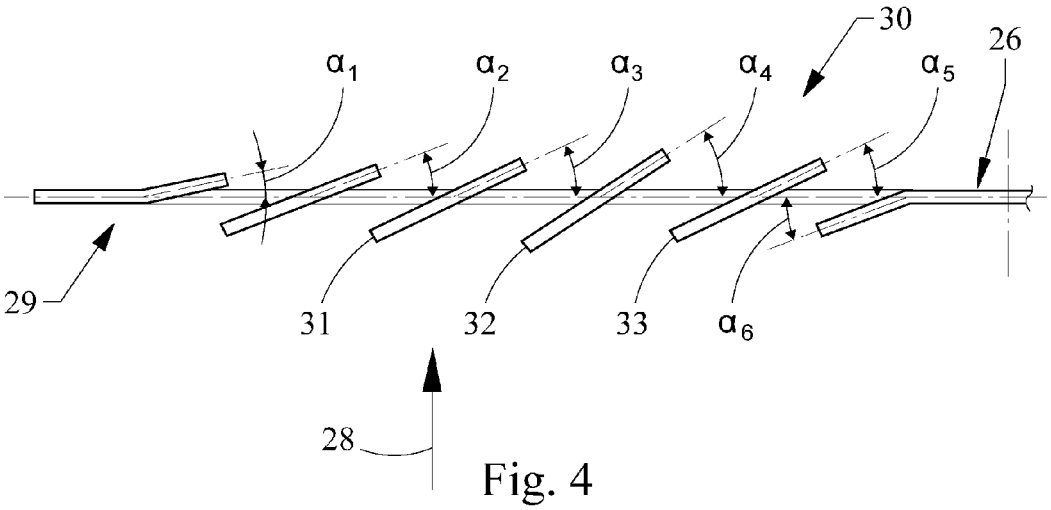
FIG. 4 is a schematic representation of a fin in longitudinal section with a louver arrangement in which there are three adjacent louvers with differently oriented, increasing-decreasing louver inclination angles from louver to louver.
Figure 5:
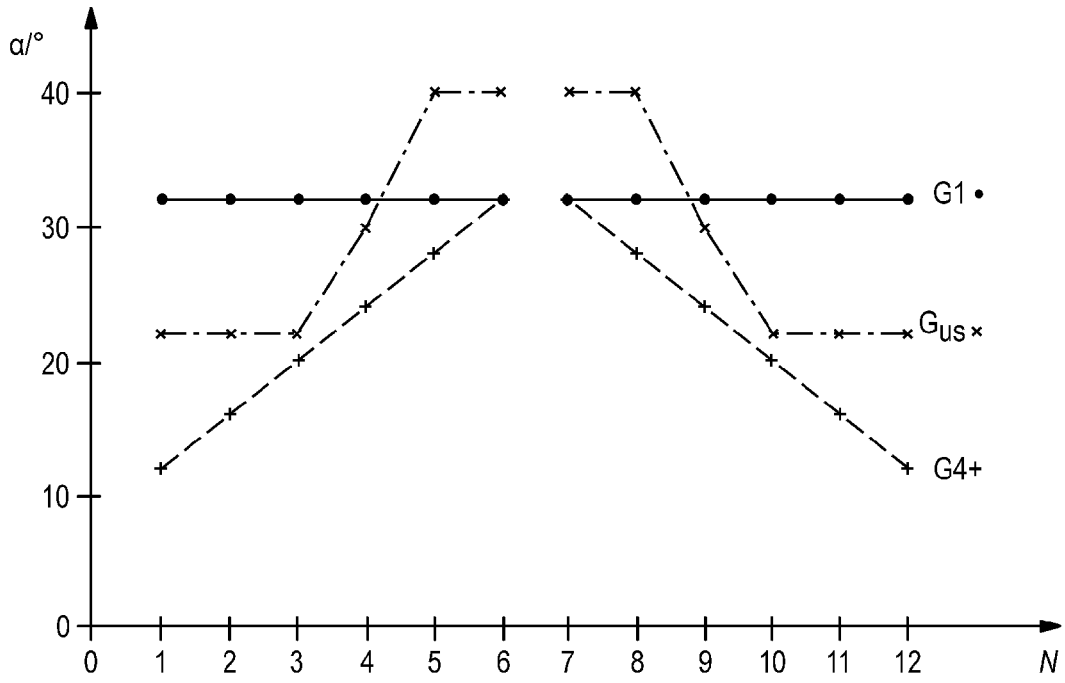
FIG. 5 is a louver inclination angle ($\alpha$/°)-louver number (N) diagram for traditional and known fins with associated geometry elements.
Figure 6:
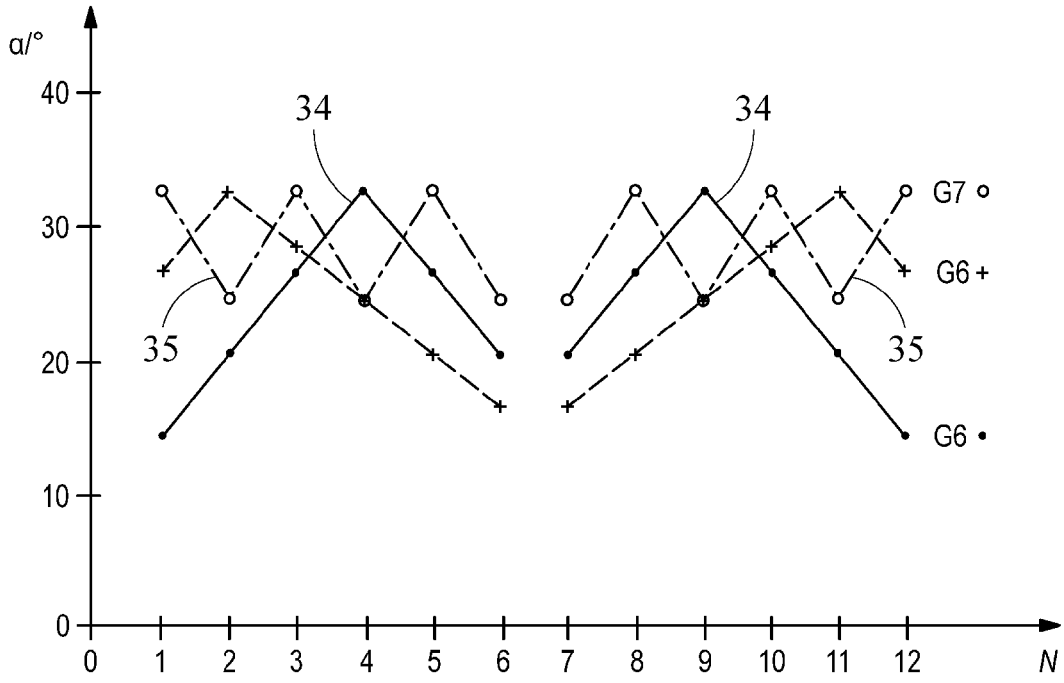
FIG. 6 is a louver inclination angle ($\alpha$/°)-louver number (N) diagram for fins of the invention with the associated geometry elements according to FIG. 4.

To support the data of Table 2 FIG. 4 is presented in connection with Table 2 showing a fin 29 with the geometry G5. Instead of both symmetrical flow parts of a louver arrangement 30 only the inflow part 28 is shown because of the symmetry to the outflow part. In the inflow part 28 in each case three adjacent louvers 31, 32, 33 of the louver arrangement 30 can be provided with the geometry element "there are unequal orientation-changing louver inclination angles $\alpha_3/\alpha_4/\alpha_5$ whereby there is at least one peak-like course 34 and/or groove-like course 35 (in FIG. 6) of the louver inclination angles $\alpha_3/\alpha_4/\alpha_5$ between the three adjacent louvers 31, 32, 33 in the inflow part 28 and/or in the corresponding outflow part". The peak-like and groove-like courses 34 (35) of the louvers 31, 32, 33 can also be transferred to the louver arrangements 2 with the curved louvers.

In a traditional gas cooler, for example, the following fin-static parameters can be given for a CFD simulation: fin depth T=12.4 mm; fin height H=6.5 mm; louver length L=4.5 mm; louver width B=1 mm; distance between the louvers A=1.0 mm; louver inclination angle $\alpha$; fin-top louver part inclination angle $\alpha_O$=28°; fin-bottom louver part inclination angle $\alpha_U$ settable 0° to 28°; material thickness D=0.08 mm. As fin pitch $s_{fin}$=1.1 mm is indicated in FIG. 2.

TABLE 2

| Louver inclination angle/° | Base fin G1 | Fin $G_{US}$ | Fin G4 | Fin 29 G5 | Fin G6 | Fin G7 |
|---|---|---|---|---|---|---|
| $\alpha_1$ | 32 | 22 | 12 | 14 | 26 | 32 |
| $\alpha_2$ | 32 | 22 | 16 | 20 | 32 | 24 |
| $\alpha_3$ | 32 | 22 | 20 | 26 | 28 | 32 |
| $\alpha_4$ | 32 | 30 | 24 | 32 | 24 | 24 |
| $\alpha_5$ | 32 | 40 | 28 | 26 | 20 | 32 |
| $\alpha_6$ | 32 | 40 | 32 | 20 | 16 | 24 |

The base fin with the geometry G1 refers to, for example, a traditional louver arrangement with a homogeneous louver inclination angle $\alpha$ of $\alpha$=32° in both the inflow part and the corresponding outflow part, which has the complimentary louver inclination angle: 180°−32°=148°. The fins with the geometries $G_{US}$ and G4 refer to louver arrangements in which the louver inclination angles change either symmetrically step-wise ($G_{US}$) or on both sides symmetrically rising (G4) to the fin centre 27. The fins with the geometries G1, $G_{US}$ and G4 are shown in the inclination angle($\alpha$)-louver number(n) courses in FIG. 5. As shown in the G5-, G6-, G7-inclination angle($\alpha$)-louver number(n) representations in FIG. 6, the louver inclination angle changes of the invention have in their course at least one peak-like change 34 or groove-like change 35, or bend, respectively, in form of a low-high-low angle change 34 or high-low-high angle change 35 between each three adjacent louvers.

The heat transfer and pressure drop values of the CFD simulation in the following Table 3 inform about the fact that the geometries G5, G6, G7 yield better values compared to the known geometries G1, G4.

TABLE 3

Values of the Nusselt number (heat transfer number) and pressure drop ($\Delta$p) obtained by CFD simulation

| Geometry | Nusselt number | Pressure drop $\Delta$p/Pa |
|---|---|---|
| G1 | 11.30 | 96.87 |
| G4 | 11.80 | 83.24 |
| G5 | 12.20 | 87.06 |
| G6 | 12.13 | 88.20 |
| G7 | 12.08 | 96.52 |

Figure 7:
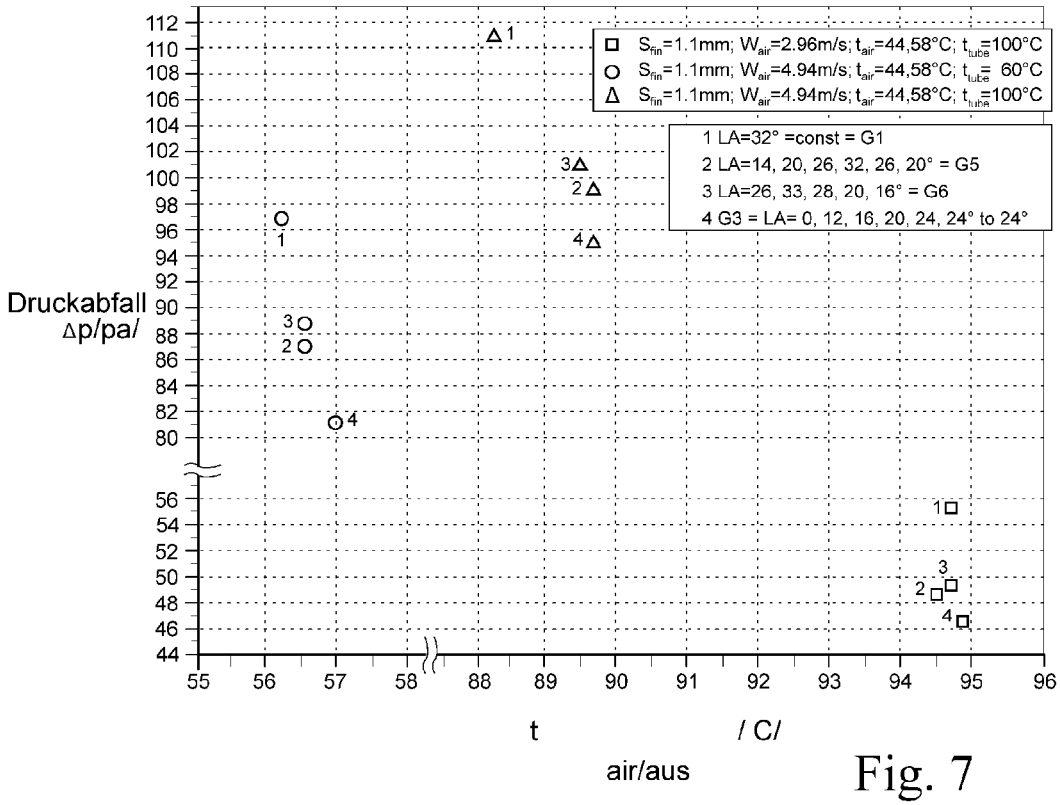
FIG. 7 is a pressure drop ($\alpha$p/Pa)-air outflow temperature ($t_{air,aus}$/° C.) comparison diagram between the base fin and the fins of the invention with inclination angle-dependent louver arrangements for a given fin pitch $s_{fin}$=1.1 mm.
Figure 8:
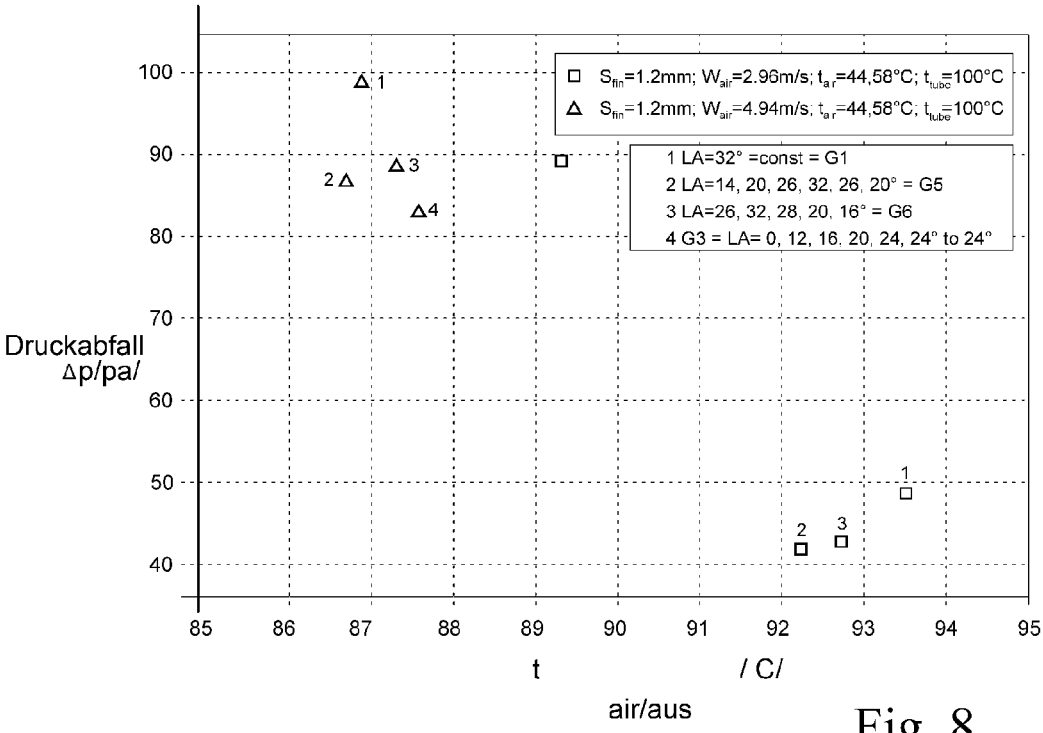
FIG. 8 is a pressure drop (Δp/Pa)-air outflow temperature ($t_{air,aus}$/° C.) comparison diagram between the base fin and fins of the invention with inclination angle-dependent louver arrangements for a different given fin pitch $s_{fin}$=1.2 mm compared to FIG. 7.

In connection with Table 3, in the FIGS. 7 and 8 the air outflow temperatures $t_{air,\ aus}$/° C. and the pressure drops $\Delta$p/Pa for the fins with geometries G5 and G6 and for the traditional fin with the geometry G1 are shown for different fin pitches $s_{fin}$=1.1 mm and 1.2 mm and, apart from that, equivalent parameters.

For the fins with the geometries G5 and G6 the pressure drop $\Delta$p is between 9% for the fin pitch $s_{fin}$=1.1 mm and an air inflow velocity $w_{air}$=4.94 m/s, and over 20% for the fin pitch $s_{fin}$=1.2 mm and an air inflow velocity $w_{air}$=2.96 m/s.

At the same time, the heat transfer, represented by the air outflow temperature $t_{air,\ aus}$, is more intensive for a higher air inflow velocity $w_{air}$ and smaller fin pitch $s_{fin}$ compared to the base fin with the geometry G1. For a smaller air inflow velocity $w_{air}$ the fins of the invention with the geometries G5 and G6 have a slightly smaller heat transfer number. This trend becomes even more distinct by the increase of the fin pitch from $s_{fin}$=1.1 mm to $s_{fin}$=1.2 mm.

From the same CFD simulation comparably better values are obtained for the louvers with a louver-internal inclination angle change for the fin of the invention with the geometry G3 in the FIGS. 7, 8.

As mentioned above, the louver parts above and below the inclination change axis P, which is the intersection line of the louver longitudinal axis and the fin surface plane 26, can have different orientations. The values of orientation-changing louver part inclination angles $\alpha_O/\alpha_U$ f the fin of the invention with the geometry G3, which has been investigated in a CFD analysis, are shown in Table 1 in addition to those of the fin 1 with the geometry G2. Compared with the fins of the geometries G5, G6, G7 the fin with the geometry G3 shows a better heat transfer by the highest air outflow temperature $t_{air;\ aus}$ and the smallest air pressure drop, as shown in the FIGS. 7, 8.

FIG. 7 shows, from the CFD simulation, the air outflow temperature $t_{air,\ aus}$ and the pressure drop Δp for the four different fin geometries G1, G5, G6, G3 for a fin pitch $s_{fin}$=1.1 mm, an air inflow temperature $t_{air}$=44,58° C. and three sets of air inflow velocity/tube temperature combinations; FIG. 8 shows that for a fin pitch $s_{fin}$=1.2 mm.

The representation in the FIGS. 7, 8 show that the fins of the invention with the geometries G5, G6, G3 with unequal louver angles for an interruption of the continuously increasing, or decreasing, respectively, inclination angles α—in FIG. 4—and/or for a change of the inclination angle to at least two louver part inclination angles $\alpha_O/\alpha_U$ within the louvers—in the FIGS. 1, 2—have better pressure drop values than traditional base fins with the base geometries G1.

Emphasizing once more, the results of the CFD simulation for curved louvers in the fin with the geometry G3 are even better than the results of the fins with the geometries G5 and G6. The reduction of the pressure drop Δp for a fin pitch $s_{fin}$=1.1 mm and an air inflow velocity $w_{air}$=4.94 m/s is approximately 14% smaller than for the base fin with the geometry G1. The louver arrangement with the fin of geometry G3 has also higher heat transfer numbers compared with the base fin with the geometry G1.

Referring to the FIGS. 1, 4 with fins 1 and 29 (G5), respectively, which on the one hand can be designed with equal louver length L, the fins 1, 29 on the other hand can be provided with preferably another geometry element "at least one louver has a longer length L' than the lengths L of the adjacent louvers within a flow part".

The actual length L/L'of the louvers is, in principle, predetermined by the length of the louver slots S/S' or 17, 18 and relevant for the fin performance. Longer passage slots S' are useful for the heat transfer, but can reduce the mechanical stability and affect the manufacturability of the fins dependent on how near the slots S' approach the fin side edges on each end side.

According to the invention two adjacent louvers, particularly two intermediate louvers, are provided with a different longitudinal slot S-S' compared with the other louvers of a flow part. Some louvers in this case can be longer than the adjacent louvers. The other louvers then are provided with a shorter slot. Thereby in the slot-free regions more cold air stream is collected. Due to vortex formation behind the elongated louver the heat transfer is enhanced, because the vortex formation occurs between the ends of shorter louvers and the heat transfer tube. At the same time, an increase of the air velocity in the centre of the fin is achieved and attempted to exploit an increase of the local heat transfer coefficient.

In Table 4, fins with the geometries G1, GL1 and GL2 are shown by the results of the CFD simulations with non-equal lengths L/L', in mm, of the louvers.

TABLE 4

| | Fins with different louver lengths L/L', in mm, with a symmetry between the inflow part and corresponding outflow part | | |
|---|---|---|---|
| Louver number | Traditional louver arrangement G1 Length/mm | Geometry GL1 Length/mm | Geometry GL2 Length/mm |
| 1 and 12 | 4.5 | 4.5 | 4.5 |
| 2 and 11 | 4.5 | 4.5 | 4.5 |
| 3 and 10 | 4.5 | 5.5 | 4.5 |
| 4 and 9 | 4.5 | 5.5 | 5.5 |
| 5 and 8 | 4.5 | 4.5 | 5.5 |
| 6 and 7 | 4.5 | 4.5 | 4.5 |

Figure 9:
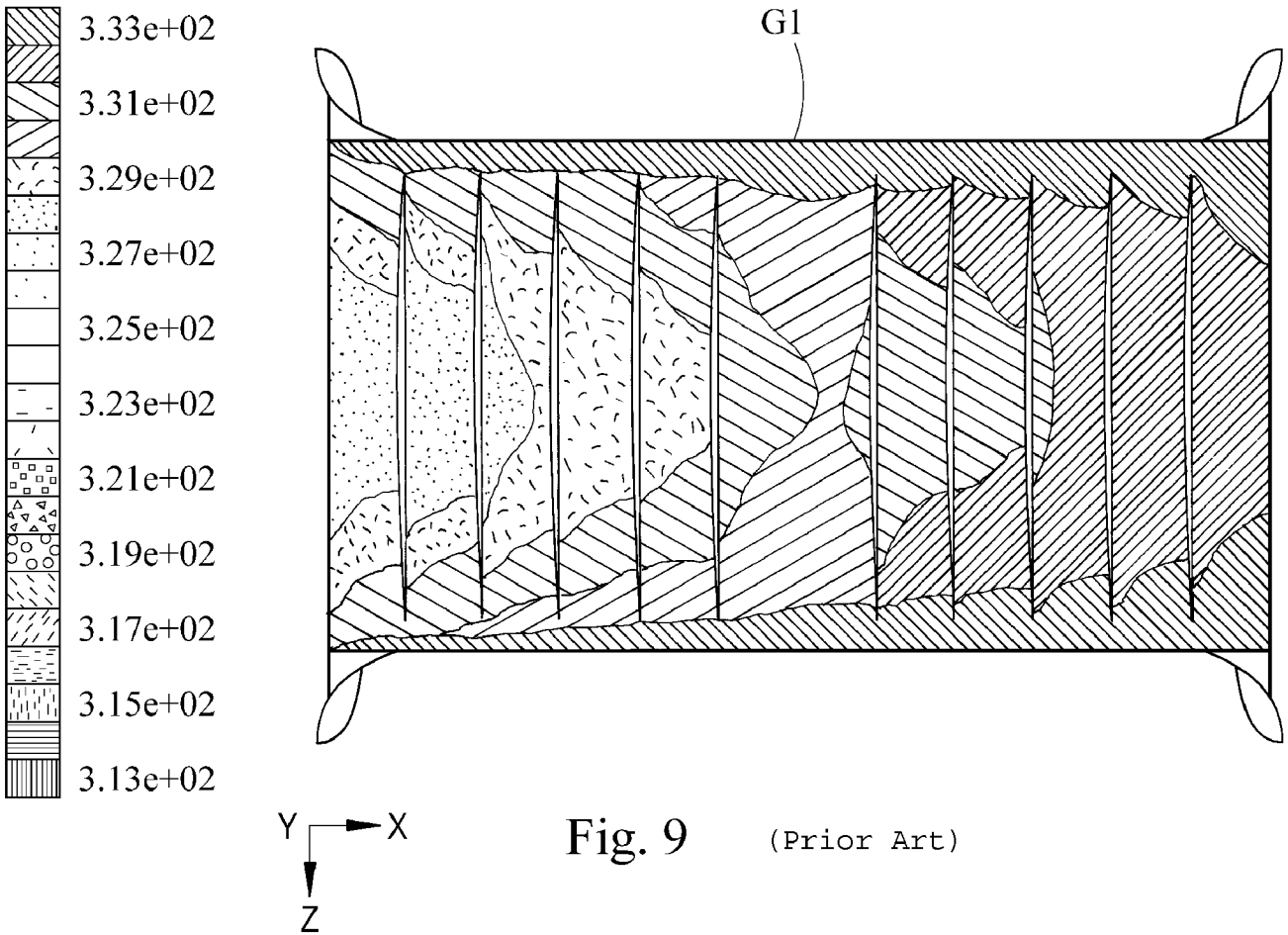
Fig. 9 (Prior Art)
FIG. 9 is a fin temperature field for a base fin with equal lengths of the passage slots, with equal lengths of the louvers and equal angles α=32°.
Figure 10:
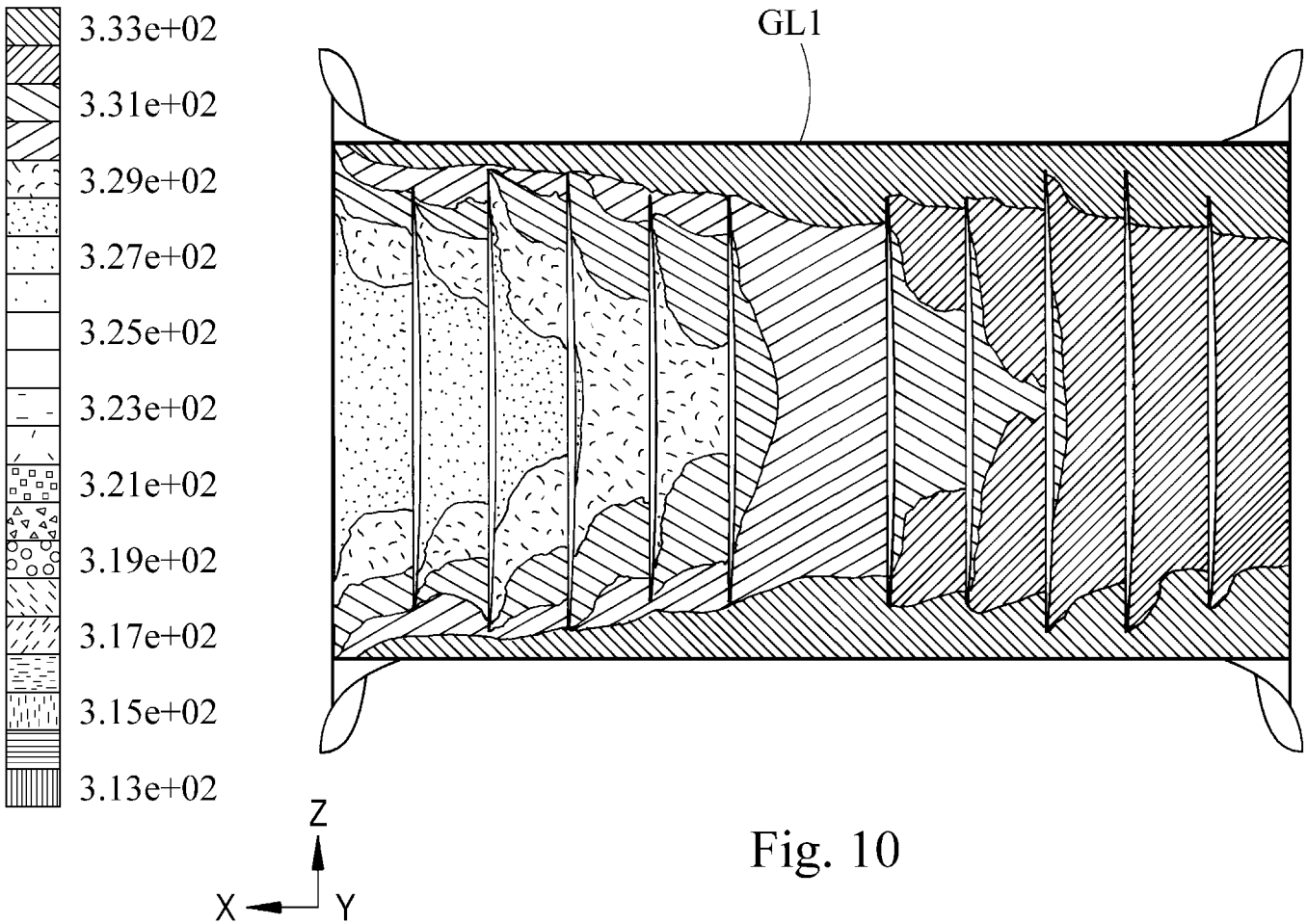
FIG. 10 is a fin temperature field for a fin of the invention with different lengths of the slots S' No. 2, 3 and therefore the lengths L' of the louvers 3, 4 in the inflow part and, correspondingly to it, in the outflow part.
Figure 11:
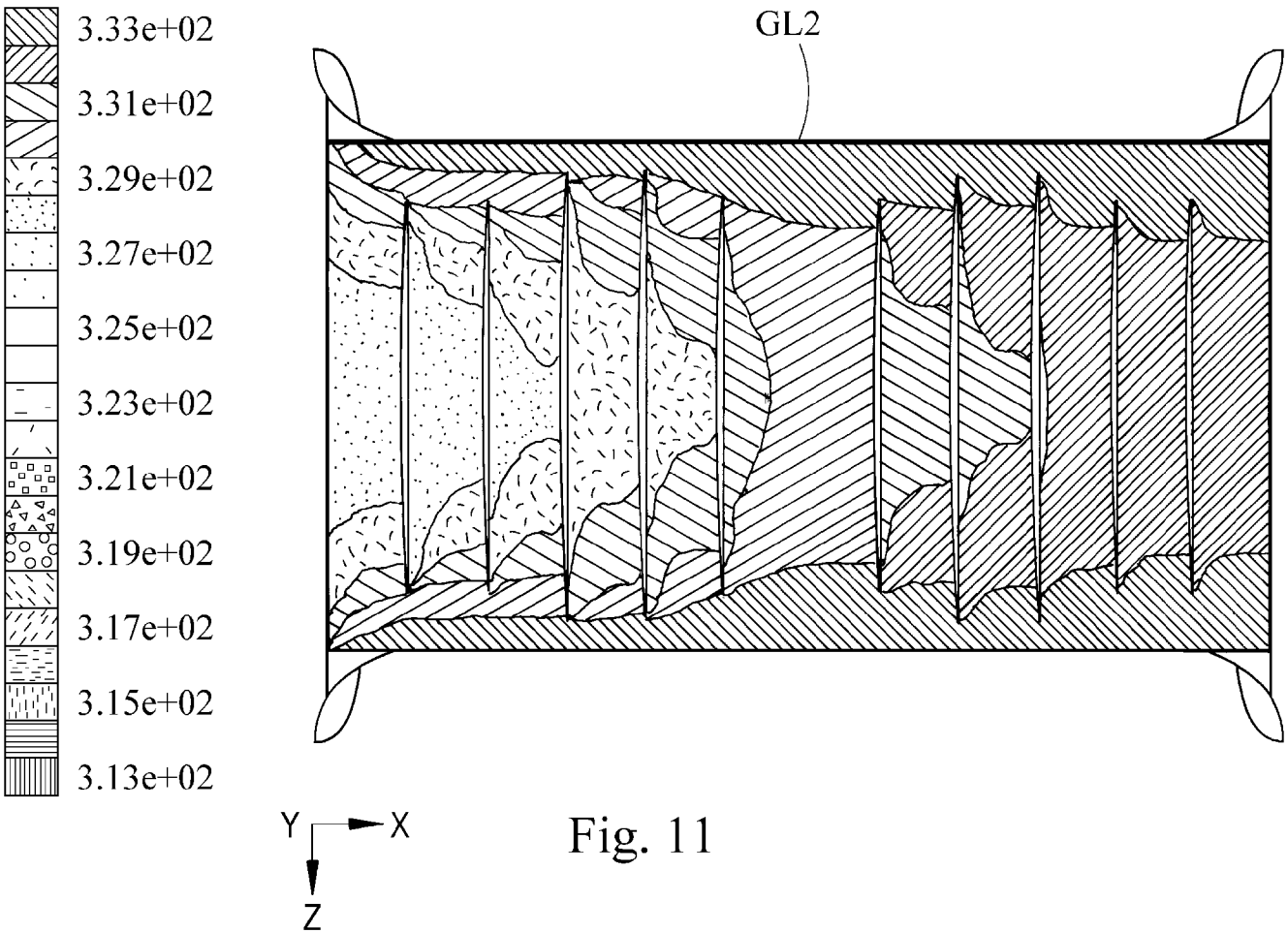
FIG. 11 is a fin temperature field for a fin B4 with different lengths of the slots 3, 4 and therefore the lengths of the louvers 4, 5 in the inflow part and, correspondingly to it, in the outflow part.

In the FIGS. 9, 10, 11 the associated fin temperature fields are shown for the fins with the geometries G1, GL1 and GL2. As the dynamic parameters of the CFD simulation an air inflow temperature $t_{air}$=40° C., an air inflow velocity $w_{air}$=3.5 m/s and a tube surface temperature $t_{tube}$=60° C. are given.

At the fin with the geometry GL1 the third and the fourth louvers in the inflow part and the ninth and the tenth louvers in the outflow part are longer (5.5 mm) than the adjacent louvers (4.5 mm). At the fin with the geometry GL2 the fourth and the fifth louvers in the inflow part and the eighth and the eleventh louver in the outflow part are longer (5.5 mm) than the adjacent louvers (4.5 mm).

The fin temperature fields in the FIGS. 9, 10, 11 show that the louver arrangements with the geometries GL1 and GL2 break open the air flow channel between the louvers and the fin ends, which leads to an increased heat transfer while it involves certain drawbacks concerning the pressure drop. Compared with the traditional base fin with the geometry G1 and the associated fin temperature field in FIG. 9, FIGS. 10, 11 indicate for the fins with the geometries GL1, GL2 an enhancement of the heat transfer performance by 3.1% with a deterioration of the pressure drop by 12.2% for the fin with the geometry GL1 and an enhancement of the heat transfer performance by 3.2% with a deterioration of the pressure drop by 12.4% for the fin with the geometry GL2.

In Table 5, some results of 3D CFD simulations are shown for a 12 mm×6, 5 mm×0.08 mm fin that show how the change of the louver length L to L' influences the heat transfer in form of the air outflow temperature $t_{air,\ aus}$ and the air pressure drop Δp.

The assumed dynamic parameters are: air inflow temperature $t_{air}$=40° C., air inflow velocity $w_{air}$=3.47 m/s, fin steps/fin pitch $s_{fin}$=1.1 mm.

For the louvers of the base fin with the geometry G1 an equally oriented inclination angle is provided. All fins are provided with six louvers on each flow part.

TABLE 5

| Fins | Louver inclination angle | Air outflow temperature ($t_{air, aus}$/° C.) | Relative temperature increase (%) | Pressure drop (Δp/Pa) | Relative pressure drop increase (%) |
|---|---|---|---|---|---|
| Base fin (G1): All louvers are of equal length 4.5 mm | 32° | 54.56 | — | 88.95 | — |
| Fin: All louvers are longer (5.5 mm) | 32° | 55.59 | 7.07 | 114.62 | 28.86 |
| Fin: The second louver (related to the inflow part) is longer (5.5 mm) | 32° | 55.25 | 4.73 | 107.37 | 20.71 |
| Fin: The third louver is longer (5.5 mm) | 32° | 55.36 | 5.49 | 111.33 | 25.16 |
| Fin: The fourth louver is longer (5.5 mm) | 32° | 55.39 | 5.70 | 111.41 | 25.25 |
| Fin: The fourth louver is little longer (5.0 mm) | 32° | 55.09 | 3.64 | 102.39 | 15.11 |

A significant improvement of the heat transfer compared to the base fin with the geometry G1 (4.5 mm) is achieved when all four louvers are elongated (5.5 mm).

In this case the air outflow temperature $t_{air, aus}$=55,59° C. is highest, which is achieved with all louvers (length=5.5 mm) longer than 4.5 mm. But there is the biggest proportional increase (28.86%) in relation to the high pressure drop Δp=114.62 Pa to be noted. Also the mechanical stability is problematic.

Similar results, with a little lower heat transfer but significantly smaller pressure drop compared with the base fin G1, are achieved with a fin with only one longer fourth louver (length 5.5 mm). Generally, it is favorable for stability reasons to establish only some of the intermediate louvers longer than one of the adjacent louvers. In a preferred way, in the following a louver arrangement with an elongated fourth louver of a length of 5.5 mm is investigated, which is longer than all louvers (length=4.5 mm) of the base fin with the geometry G1.

The last row in Table 5 shows what happens to the air outflow temperature $t_{air, aus}$ and the air pressure drop Δp, if the fourth louver has an only little longer length (5.0 mm) but is longer than the fourth louver of the base fin G1. Then the heat transfer and the pressure drop values have a tendency towards the values of the base fin G1 again.

In Table 7, some results of 3D CFD simulations are shown for a 12 mm×6, 5 mm×0.08 mm fin that show how in combination of two geometry elements of the invention—first, "a fourth longer louver with the louver length L=5.5 mm" and second, "with at least one louver with unequal louver part inclination angles $\alpha_{nO}/\alpha_{nU}$ on an inclination change axis located in the intersection point between the louver longitudinal axis and fin surface plane 26"—the heat transfer in form of the air outflow temperature $t_{air, aus}$ and the pressure drop Δp is influenced.

The same dynamic parameters as for Table 5 are used: air inflow temperature $t_{air}$=40° C., air inflow velocity $w_{air}$=3.47 m/s, fin steps/fin pitch $s_{fin}$=1.1 mm.

For the louvers of the base fin with the geometry G1 an equal inclination angle α=32° is provided. The fins are provided with six louvers on each flow part.

Table 7 shows which heat transfer is obtained for reduced pressure drop, whereby the pressure drop can fall significantly when the heat transfer reaches a high level.

TABLE 7

| Fins | Air inflow velocity (m/s) | Air outflow temperature (° C.) | Relative temperature increase (%) | Pressure drop (Pa) | Relative pressure drop (%) |
|---|---|---|---|---|---|
| Base fin G1: All louvers have an identical length of 4.5 mm and an identical louver inclination angle of 32°, there is no inclination change axis | 3.47 | 54.56 | — | 88.95 | — |

TABLE 7-continued

| Fins | Air inflow velocity (m/s) | Air outflow temperature (° C.) | Relative temperature increase (%) | Pressure drop (Pa) | Relative pressure drop (%) |
|---|---|---|---|---|---|
| Fin GL3: Only the 4th louver is longer, length 5.5 mm, louver part inclination angle on both sides = 32°, there is no inclination change axis | 3.47 | 55.39 | 7.07 | 111.41 | 28.86 |
| Fin GL4: Only the 4th louver has a length of 5.5 mm. Upper/lower louver part inclination angles: 24/0, 24/12, 24/16, 24/20, 24/24, 0/24°, there is an inclination change axis | 3.47 | 55.03 | 3.23 | 82.61 | −7.13 |
| Fin GL5: Only the 4th louver has a length of 5.5 mm. Upper/lower louver part inclination angles: 28/0, 28/12, 28/18, 28/22, 28/28, 0/28°, there is an inclination change axis | 3.47 | 55.19 | 4.33 | 89.00 | 0 |
| Fin GL6: Only the 4th louver has a length of 5.5 mm. Upper/lower louver part inclination angles: 24/0, 24/12, 24/16, 24/20, 24/24, 0/24°, there is an inclination change axis | 2.00 | 57.26 | diff. $w_{air}$ | 36.83 | diff. $w_{air}$ |
| Fin GL7: Only the 4th louver has a length of 5.5 mm. Upper/lower louver part inclination angles: 28/0, 28/12, 28/18, 28/22, 28/28, 0/28°, there is an inclination change axis | 2.00 | 57.14 | diff. $w_{air}$ | 40.01 | diff. $w_{air}$ |

From Table 7 it is seen that the fins GL4, GL5, GL6, GL7 with the combination of the geometry elements "unequal length of at least one louver compared to the adjacent louvers" and "variation (GL4/GL5 and GL6/GL7) of the unequal upper/lower louver part inclination angles related to the curved louvers" can significantly improve the heat transfer by an equal or even increasing value of the pressure drop also compared with the base fin with the geometry G1.

For higher air inflow temperatures and higher air velocities the relative improvement of the heat transfer increases obtained due to the enlarged unequal louver cross-section and unequal louver length and the curved louvers as well. For example, for an air inflow velocity $w_{air}$=5.0 m/s and an air inflow temperature $t_{air}$=45° C. with the same values of the other dynamic parameters the heat transfer improvement is increased by 8.55% compared to the base fin with the geometry G1 for the same conditions of the fin geometry with the fourth louver, which is 5.5 mm long, with two unequal louver part inclination angles and with partly continuously or completely continuously curved louvers (for example, upper/lower louver part inclination angles: 28/0, 28/12, 28/18, 28/22, 28/28, 0/28°).

In a further improvement of the fin geometry according to the invention, different, non-symmetrical inflow parts and outflow parts can be established particularly concerning different lengths of various louvers. Some of the louver arrangements with different louver lengths L/L' for a given asymmetry between the inflow part and the corresponding outflow part are shown in Table 6.

TABLE 6

| Fins in louver asymmetry between inflow parts and outflow parts | | | | | | | | | |
|---|---|---|---|---|---|---|---|---|---|
| Number of the louver | Fin G1 | Fin GL8 | Fin GL9 | Fin GL10 | Fin GL11 | Fin GL12 | Fin GL13 | Fin GL14 | Fin GL15 |
| 1 | 4.5 | 4.5 | 4.5 | 4.5 | 5.0 | 4.5 | 4.5 | 4.5 | 4.5 |
| 2 | 4.5 | 5.5 | 4.5 | 5.0 | 5.0 | 4.5 | 5.0 | 5.0 | 4.5 |
| 3 | 4.5 | 5.5 | 4.5 | 5.5 | 4.5 | 4.5 | 4.5 | 4.5 | 5.5 |
| 4 | 4.5 | 5.5 | 4.5 | 4.0 | 4.5 | 4.5 | 4.5 | 5.0 | 4.5 |
| 5 | 4.5 | 4.5 | 4.5 | 5.0 | 4.5 | 4.5 | 4.5 | 5.0 | 4.5 |
| 6 | 4.5 | 4.5 | 5.5 | 4.5 | 4.5 | 4.5 | 4.5 | 4.5 | 5.5 |
| 7 | 4.5 | 5.5 | 4.5 | 4.5 | 4.5 | 4.5 | 5.5 | 4.5 | 4.5 |
| 8 | 4.5 | 4.5 | 4.5 | 5.0 | 5.0 | 5.5 | 5.0 | 5.0 | 4.5 |
| 9 | 4.5 | 4.5 | 5.5 | 4.5 | 4.5 | 4.5 | 4.5 | 4.5 | 5.5 |

TABLE 6-continued

| Fins in louver asymmetry between inflow parts and outflow parts | | | | | | | | | |
|---|---|---|---|---|---|---|---|---|---|
| Number of the louver | Fin G1 | Fin GL8 | Fin GL9 | Fin GL10 | Fin GL11 | Fin GL12 | Fin GL13 | Fin GL14 | Fin GL15 |
| 10 | 4.5 | 5.5 | 4.5 | 4.5 | 4.5 | 4.5 | 4.5 | 4.5 | 4.5 |
| 11 | 4.5 | 4.5 | 4.5 | 4.5 | 4.5 | 4.5 | 4.5 | 5.0 | 4.5 |
| 12 | 4.5 | 4.5 | 4.5 | 4.5 | 4.5 | 4.5 | 4.5 | 4.5 | 4.5 |

According to the invention, also the louver pitch, i.e. the distance A as shown in FIG. 2, as another geometry element according to the invention can be different between two adjacent louvers on one fin, for example, on fin 1.

In FIG. 12 several fin details concerning variations of fins with different louver sectional profiles are shown as further geometry element of the invention.

Hereby, also on one fin, different shapes of the louver sectional profile are provided. For comparison, a detail of a fin of the invention with the geometry GL1 with the fin height H, louver length L and the two longer louvers L' is shown in FIG. 12.

Apart from concave, convex, arrow-like, coil-shaped or also interrupted sectional profile, the traditional geometry of the fins and the louvers is broken. Hereby, the sectional profiles shown in compactness imply different angles $\alpha/\alpha'$, different louver widths B/B', different louver lengths L/L'and distances A/A', several inclination change axes P/P' in the region of the louvers as well as symmetries and asymmetries between the inflow parts and the corresponding outflow parts. As to the fin geometry, the louver arrangement can then be provided with the geometry element "with different slot sections S, S'", whereby the guide lines of the slots S, S' realize different louvers such that they have different widths, alternating different lengths and/or changed curvatures and/or differently oriented inclination angles which can optionally vary from louver to louver.

According to the invention the fin geometry elements and louver geometry elements can be combined singly, two-fold or multiply with one another, whereby the geometry elements mentioned before can be combined, depending on the demand, partly on louvers with entirely equal louver width and/or with entirely equal louver inclination angle and/or with entirely equal louver length.

The process of the invention for the production of a fin of the invention with at least one louver arrangement and at least one fin geometry element of the invention and/or one louver geometry element of the invention can have the following steps:

1. definition of a fin after optional use of CAD programmes,
2. predetermination of static parameters of the fin dimensions and of fin geometry elements and of louver geometry elements,
3. predetermination of dynamic parameters—e.g., medium inflow temperature, medium inflow velocity, medium outflow temperature, pressure drop of the flowing medium —,
4. execution of CFD simulations,
5. recording of heat transfer fields and
6. recording of medium flow fields preferably using laser devices,
7. evaluation of the heat transfer and flow fields obtained after measurement, particularly, of the medium outflow temperatures and the pressure drop,
8. variation and selection of the predetermined geometry elements for the fin with an optimization concerning the maximum heat transfer and minimum pressure drop of the flowing medium,
9. evaluation of the CFD simulations and
10. manufacture of the optimized fin.

The invention makes it possible to obtain better medium flow fields between the fins which are changed by means of geometry elements.

Further, the invention makes it possible, due the extensive agreement between the numerical evaluations and the investigation results obtained for both the temperature and the medium (air) pressure drop data, to create technical usability of the fins of the invention by means of CFD simulation.

The louver arrangements according to the invention raise the possibility to optimally match the heat transfer and the pressure drop to each other in the fins.

What is claimed is:

1. In a heat exchanger having at least one pair of adjacent tubes with a fin extending therebetween, the fin including at least one louver arrangement for heat transfer from a medium located in the tubes to a second medium flowing outside of the tubes and over the fin, the louver arrangement comprising:

an inflow part, an outflow part, both the inflow and outflow parts each having a series of adjacent louvers including an outside louver, at least one intermediate louver, and an inside louver, a plurality of passage slots formed in the fin and at least one passage slot being located between each adjacent louver, the inside louver of the inflow part being connected to the inside louver of the outflow part, all of the louvers of the inflow part being arranged inclined relative to all of the louvers of the outflow part such that the inflow part and the outflow part are symmetrical to one another, all of the louvers being provided with louver geometry elements of length L, width B, and an angle of inclination $\alpha$, wherein the angle of inclination of at least one of the louvers of the inflow part is different from the angle of inclination of the remaining louvers of the inflow part and, proceeding from the outside louver of the inflow part to the inside louver, of the inflow part, the angles of inclination of the louvers progressively increase and thereafter decrease.

2. The heat exchanger of claim 1 wherein the angles of inclination of at least four of the louvers of the inflow part are different from the angles of inclination of the remaining louvers of the inflow part.

3. The heat exchanger of claim 1 wherein at least one of said intermediate louvers is a multiple-curved louver.

4. The heat exchanger of claim 3 wherein curvature within the at least one of said intermediate louvers is provided by a bend.

5. The heat exchanger of claim 3 wherein curvature within the at least one of said intermediate louvers is provided by an arch.

6. The heat exchanger of claim 1 wherein at least one of any of the louvers has a length unequal to a length of an adjacent louver.

7. The heat exchanger of claim 6 wherein the inflow part includes six louvers and the fourth louver in the inflow part has a longer length than the length of an adjacent louver.

8. The heat exchanger of claim 1 wherein at least one intermediate louver of either the inflow or outflow part has a width being unequal to a width of an adjacent intermediate louver.

9. The heat exchanger of claim 1 wherein at least three adjacent louvers of either the inflow part or the outflow part are provided with unequal angles of inclination such that between the three adjacent louvers there is defined a peak or a groove by the relative ends of these louvres.

10. The heat exchanger of claim 1 wherein the width of at least one of the louvers is different from the width of all of the other louvers.

11. The heat exchanger of claim 1 wherein at least some of the adjacent louvers define profiles of different shapes along their lengths the louvers.

12. The heat exchanger of claim 1 wherein the geometry elements are commonly provided in all of the louvers having equal louver widths, equal louver inclination angles or equal louver lengths.

13. The heat exchanger of claim 1 wherein the width of at least one of the louvers is different from the width of all of the other louvers.

14. In a heat exchanger having at least one pair of adjacent tubes with a fin extending therebetween, the fin including at least one louver arrangement for heat transfer from a medium located in the tubes to a second medium flowing outside of the tubes and over the fin, the louver arrangement comprising:

an inflow part, an outflow part, both the inflow and outflow parts each having a series of adjacent louvers including an outside louver, at least one intermediate louver, and an inside louver, a plurality of passage slots formed in the fin and at least one passage slot being located between each adjacent louver, the inside louver of the inflow part being connected to the inside louver of the outflow part, all of the louvers of the inflow part being arranged inclined relative to all of the louvers of the outflow part such that the inflow part and the outflow part are symmetrical to one another, all of the louvers being provided with louver geometry elements of length L, width B, and an angle of inclination $\alpha$, wherein the angle of inclination of at least one of the louvers of the inflow part is different from the angle of inclination of the remaining louvers of the inflow part, and wherein at least one of said intermediate louvers is a single-curved intermediate louver defining a fin-top louver part and a fin-bottom louver part, each of the fin-top and fin-bottom louver parts defining an angle of inclination.

15. The heat exchanger of claim 14 wherein the fin-top louver parts have a common angle of inclination and at least one of the fin-bottom louver parts has an angle of inclination different from the angle of inclination of the remaining fin-bottom louver parts.

16. The heat exchanger of claim 14 wherein curvature within the at least intermediate louver is provided by a bend.

17. The heat exchanger of claim 14 wherein curvature within the at least intermediate louver is provided by an arch.

18. The heat exchanger of claim 14 wherein at least one of the intermediate louvers of each of the inflow part and outflow part are single-curved in the direction of their width (B) and provided with at least one louver-internal inclination angle change ($\alpha_{nO}/\alpha_{nU}$) at an intersection point axis between a louver longitudinal axis and a fin surface plane, whereby the inclination angle change defines unequally oriented fin-top louver parts and unequally oriented fin-bottom louver parts.

19. The heat exchanger of claim 18 wherein the orientation of the fin-top louver parts is equal and at least one of the fin-bottom louver parts is provided with a different orientation to the others of the fin-bottom lover parts.

20. The heat exchanger of claim 18 wherein the orientation of the fin-bottom louver parts is equal and at least one of the fin-top louver parts is provided with a different orientation to the others of the fin-top louver parts.

21. The heat exchanger of claim 14 wherein at least one louver in relation to all of the other louvers has an inhomogeneous length and wherein at least one louver has an inhomogeneous upper/lower louver part inclination angles $\alpha_{nO}/\alpha_{nU}$ in relation to all of the other louvers.

22. The heat exchanger of claim 14 wherein the inflow part and the outflow part have different lengths (L/L') of various louvers.

23. The heat exchanger of claim 14 wherein at least one of any of the louvers has a length unequal to a length of an adjacent louver.

24. The heat exchanger of claim 23 wherein the inflow part includes six louvers and the fourth louver in the inflow part has a longer length than the length of an adjacent louver.

25. The heat exchanger of claim 14 wherein at least some of the adjacent louvers define profiles of different shapes along their lengths the louvers.

26. The heat exchanger of claim 14 wherein the geometry elements are commonly provided in all of the louvers having equal louver widths, equal louver inclination angles or equal louver lengths.

27. In a heat exchanger having at least one pair of adjacent tubes with a fin extending therebetween, the fin including at least one louver arrangement for heat transfer from a medium located in the tubes to a second medium flowing outside of the tubes and over the fin, the louver arrangement comprising:

an inflow part, an outflow part, both the inflow and outflow parts each having a series of adjacent louvers including an outside louver, at least one intermediate louver, and an inside louver, a plurality of passage slots formed in the fin and at least one passage slot being located between each adjacent louver, the inside louver of the inflow part being connected to the inside louver of the outflow part, all of the louvers of the inflow part being arranged inclined relative to all of the louvers of the outflow part such that the inflow part and the outflow part are symmetrical to one another, all of the louvers being provided with louver geometry elements of length L, width B, and angle of inclination $\alpha$, wherein the angle of inclination of at least one of the louvers of the inflow part is different from the angle of inclination of the remaining louvers of the inflow part and wherein at least one of the intermediate louvers is multiple-curved in direction of their width, wherein a multiple-curved louver includes a louver-internal inclination angle change at an intersection point axis between a louver longitudinal axis and a fin surface plane and at least one louver-internal inclination angle change in at least one axis that is outside of the intersection point axis between the louver longitudinal axis and the fin surface plane parallel to the intersection point axis.

* * * * *

UNITED STATES PATENT AND TRADEMARK OFFICE

CERTIFICATE OF CORRECTION

PATENT NO. : 7,428,920 B2
APPLICATION NO. : 10/922469
DATED : September 30, 2008
INVENTOR(S) : Dragi Antonijevic It is certified that error appears in the above-identified patent and that said Letters Patent is hereby corrected as shown below:

Col. 19, in claim 9, line 2, after “relative ends of these” delete “louvres” and substitute --louvers-- in its place.

Col. 20, in claim 19, line 2, after “the fin-bottom” delete “lover” and substitute --louver-- in its place.

Signed and Sealed this

Seventeenth Day of March, 2009

JOHN DOLL
*Acting Director of the United States Patent and Trademark Office*